US007802600B2

(12) United States Patent
Kobayashi

(10) Patent No.: US 7,802,600 B2
(45) Date of Patent: Sep. 28, 2010

(54) DOUBLE-SIDED PRINTING LABEL PRINTER

(75) Inventor: Kenji Kobayashi, Tokyo (JP)

(73) Assignee: Lintec Corporation, Tokyo (JP)

( * ) Notice: Subject to any disclaimer, the term of this patent is extended or adjusted under 35 U.S.C. 154(b) by 639 days.

(21) Appl. No.: 11/721,021

(22) PCT Filed: Dec. 7, 2005

(86) PCT No.: PCT/JP2005/022440

§ 371 (c)(1),
(2), (4) Date: Jun. 6, 2007

(87) PCT Pub. No.: WO2006/070569

PCT Pub. Date: Jul. 6, 2006

(65) Prior Publication Data

US 2010/0012276 A1 Jan. 21, 2010

(30) Foreign Application Priority Data

Dec. 28, 2004 (JP) ..... 2004-381339

(51) Int. Cl.

| | |
|---|---|
| ***B65C 9/26*** | (2006.01) |
| ***B65C 9/18*** | (2006.01) |
| ***B29C 65/48*** | (2006.01) |
| ***B32B 37/00*** | (2006.01) |
| ***B65H 37/00*** | (2006.01) |

(52) U.S. Cl. ..... 156/387; 156/391; 156/537; 156/540; 156/541; 156/542; 156/DIG. 33

(58) Field of Classification Search ..... 156/349, 156/377, 389, 360–362, 387, 391, 537, 540–542, 156/DIG. 33
See application file for complete search history.

(56) References Cited

U.S. PATENT DOCUMENTS

| | | | | |
|---|---|---|---|---|
| 3,524,782 | A * | 8/1970 | Buske | 156/248 |
| 5,342,461 | A * | 8/1994 | Murphy | 156/64 |
| 5,686,159 | A * | 11/1997 | Langan | 428/40.1 |
| 6,786,263 | B1 | 9/2004 | Fox, Jr. et al. | |
| 6,811,645 | B2 * | 11/2004 | Bannert | 156/249 |

FOREIGN PATENT DOCUMENTS

| | | | |
|---|---|---|---|
| EP | 392643 | A2 * | 10/1990 |
| JP | 05-319406 | A | 12/1993 |
| JP | 11-001080 | A | 1/1999 |
| JP | 2002-096531 | A | 4/2002 |
| WO | WO 0007807 | A1 * | 2/2000 |

* cited by examiner

*Primary Examiner*—Philip C Tucker
*Assistant Examiner*—Sing P Chan
(74) *Attorney, Agent, or Firm*—Lowe Hauptman Ham & Berner LLP

(57) ABSTRACT

A first printing device 12 that performs the printing on a first label L1, a second printing device 18 that performs the printing on a second label L2, and a laminating section 20 that laminates these labels one another and discharges the same therefrom and a sticking device 21 that sticks the first and second labels L1 and L2 to an object W. An unprinted surface of the second label L2 is attached to an adhesive layer A of the first label L1 and a printed surface of the second label L2 is positioned between the object W and the same to be hidden.

20 Claims, 10 Drawing Sheets

DOUBLE-SIDED PRINTING LABEL PRINTER

RELATED APPLICATIONS

The present application is based on, and claims priority from, International Application Number PCT/JP05/022440, filed Dec. 7, 2005 and Japanese Patent Application No. 2004-381339, filed Dec. 28, 2004 the disclosures of which are hereby incorporated by reference herein in their entirety.

TECHNICAL FIELD

The present invention relates to a printer for double-sided printing label, in particular, to a printer for double-sided printing label suitable for printing on each of two labels, laminating these labels one another and sticking the labels onto an object to be stuck therewith in a state that a printed surface of one of labels is concealed.

TECHNICAL BACKGROUND

In these days, mail-order sale has become widely used and articles are delivered to consumers by deliverers in place of sellers. On a container like a box for packaging an article, a delivery chit is stuck. On such a delivery chit, in addition to an address and name of a receiver of the article, ordinarily, name of article, amount of money to be received and the like are indicated.

Since the name of article relates to privacy of its receiver, it is required to be hidden from the deliverer. Also, the amount of money to be received represents the worth of the article. In view of eliminating the risk of theft, it is understood that such information bears confidentiality.

Under such circumstances, a delivery chit in which a plurality of forms are bundled is used to hide the information to be concealed such as name of article, amount of money to be received and the like. There is a disadvantage such that only an impact printer is applicable to such delivery chit.

Patent document 1 discloses a double-sided printing label printer capable of, using a label previously arranged with an area with no adhesive layer on the rear face side thereof, printing on the area with no adhesive layer. The printer comprises first and second printing devices that perform printing on each of the front and rear surfaces of the label while the label, which is temporarily stuck on a release liner, is fed out.

[Patent document 1] U.S. Pat. No. 6,786,263

SUMMARY OF THE INVENTION

Problem to be Solved by the Invention

According to the double-sided printing label printer of the patent document 1, when a label is stuck onto an object, information printed on the rear face side of the label can be concealed.

However, in the double-sided printing label printer as set forth in the patent document 1, in order to perform the printing on the side having an adhesive layer of the label, such a process not to form such adhesive layer in an area where is intended to be subjected to the printing is required. Moreover, the release liner has to be formed with a hole that has no adhesive layer in the area corresponding to the area where is intended to be subjected to the printing.

Therefore, there arises such disadvantage that, every time when a change is made in the printing area at the adhesive layer side, i.e., at the rear face side of the label, it is required to change the layout of the adhesive layer and the configuration of the hole with no adhesive layer on the release liner; and thus, degree of selecting freedom for the printing area is restricted.

Object of the Invention

The present invention has been proposed in view of the forgoing disadvantages. It is an object of the present invention to provide a double-sided printing label printer basically arranged to laminate two pieces of labels one another, which eliminates the restriction on the layout of the adhesive layer at the front face side to be limited to a local area, and which permits the printing on the respective labels with no restriction on the size and/or location of the printing area in the label located at the rear face side thereof, and which is capable of sticking the labels onto the object in a state that printed information on the label located at the rear face side is hidden.

Means for Solving the Problem

To achieve the object, a double-sided printing label printer according to the present invention comprises:

a first printing device that performs printing on a first label while the first label is being fed-out, the first label having an adhesive layer on one surface thereof;

a second printing device that performs printing on a second label while the second label is being fed-out; and a laminating section that laminates an unprinted surface of the second label to the adhesive layer side of the first label and discharges the first and second labels in a state the adhesive layer of the first label is partially exposed out of the second label.

In the double-sided printing label printer according to the present invention, the second label is formed of a strip of sheet, the double-sided label printer is provided with a cutting device that cuts off the strip of sheet to a predetermined length to form the second label at the downstream side behind the second printing device in the feed-out direction.

Also, the double-sided printing label printer according to the present invention, comprises:

a first printing device that performs printing on a first label while a raw sheet is being fed out, the raw sheet being temporarily stuck with the first label on one surface of a strip of release liner being interposed by an adhesive layer;

a second printing device that performs printing on a second label while a raw sheet is being fed out, the second label being temporarily stuck on one surface of a strip of a release liner; and a laminating section that peels off each of the first and second labels and laminates an unprinted surface of the second label to the adhesive layer side of the first label, and discharges the first and second labels in a state that the adhesive layer of the first label is partially exposed outside the second label.

The laminating section of the double-sided printing label printer is arranged to guide the respective labels in such a way that the first and second labels flow together with each other.

Further, a laminating device that holds and sticks the first and second labels stuck with each other onto a predetermined object may be included.

Furthermore, the double-sided printing label printer may further comprise a sticking device that sticks the first and second labels to a predetermined object, wherein the laminating section is arranged in such a way that the sticking device laminates an unprinted surface of the second label to an adhesive layer of the first label while the sticking device holds the first label and moves to the object.

Further, the second label can be laminated in a state that a part thereof protrudes from the outer edge of the first label.

Further, the second label may be formed in a smaller size than that of the first label and laminated without protruding from the outer edge of the first label.

Furthermore, the first label is preferably formed with a cut-off line in a part thereof for permitting the first label to be cut off along with the second label.

Still further, the first label may be formed with a cut-off line and a cut-off in a part thereof for permitting the first label to be cut off along with the second label.

EFFECT OF THE INVENTION

According to the double-sided printing label printer of the present invention, the adhesive layer of the first label is laminated with the unprinted surface of the second label. Therefore, it is not required to form the adhesive layer partially including an area with no adhesive layer in the first label, and the double-sided printing is carried out with no restrictions on the area and/or position to be laminated with the first and second labels.

In the case that the unprinted surface of the second label is made of a sheet with no adhesion, the second label can be laminated in a state that a part of the second label protrudes out of the outer edge of the first label. Accordingly, a nip-margin can be formed for tearing the second label after the first and second labels are stuck on the object.

When such type of a raw sheet is employed that the first and second labels are formed separately and are temporarily stuck on a strip of release liner respectively, the double-sided printer having no cutting device aforementioned can be provided.

In the case of the double-sided printing label printer provided with the sticking device, the printing and sticking of the label can be carried out continuously. For example, when the double-sided printing label printer is disposed along a line sequentially conveying objects, an advantage is achieved such that the double-sided printing label printer can be easily incorporated into a system in a delivery center or the like.

Further, when a cut-off line or a cut-off is formed in a part of the first label, the second label can be easily torn along with the part of the first label in a state being stuck on the object.

EXPLANATION OF THE REFERENCE NUMERALS

10 Double-Sided Printing Label Printer
12 First Printing Device
18 Second Printing Device
19 Cutting Device
20 Laminating Section
21 Sticking Device
M1 First Label Raw Sheet
M2 Second Label Raw Sheet
S, S2 Release Liner
L1 First Label
L2 Second Label
C Cut-Off
PL Perforated Line
W Object

PREFERRED EMBODIMENT FOR WORKING THE INVENTION

Now, embodiments of the present invention will be described below with reference to the drawings.

First Embodiment

Figure 1:
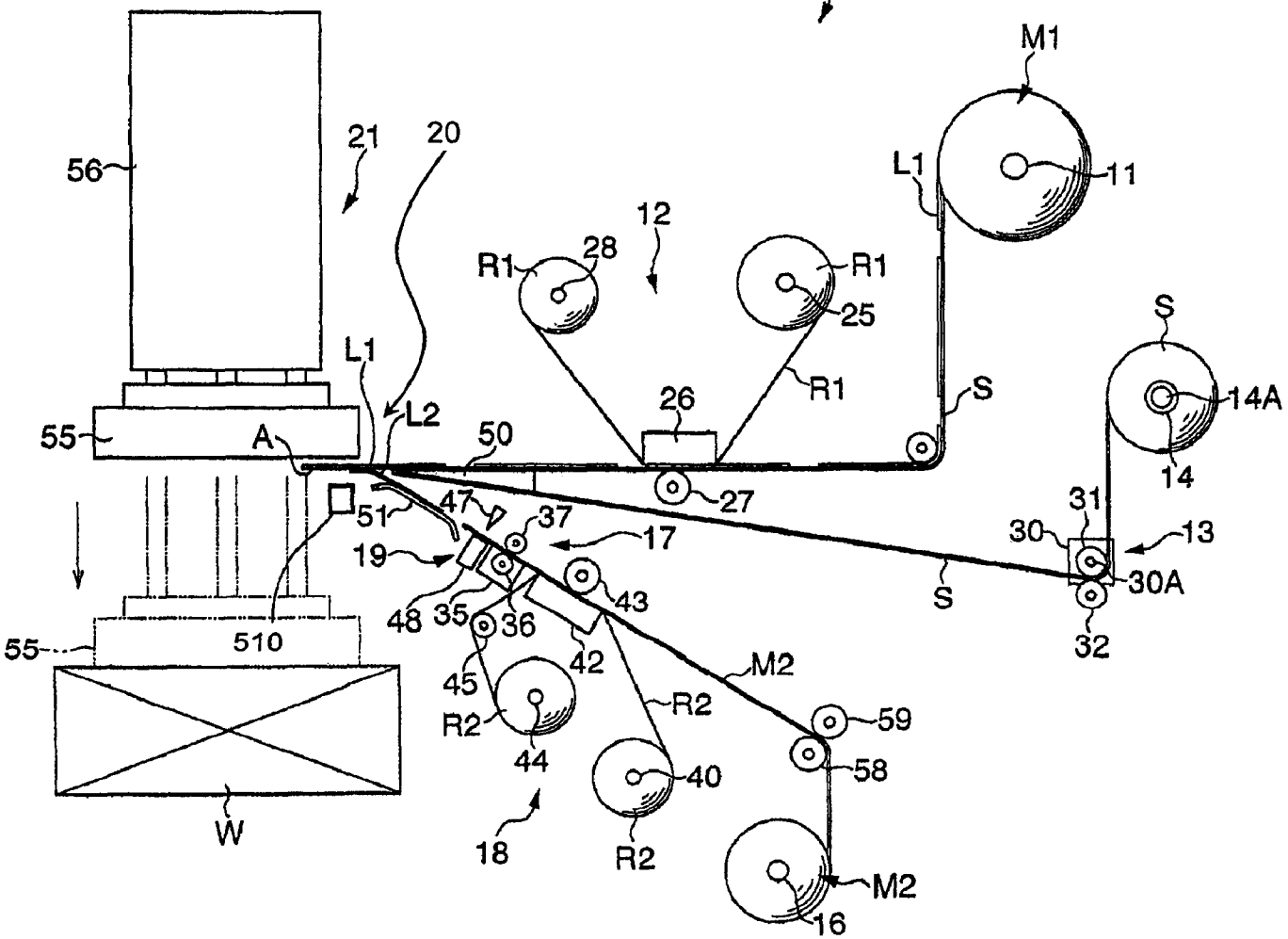
FIG. 1 is a schematic front view of a double-sided printing label printer according to a first embodiment.
Figure 2:
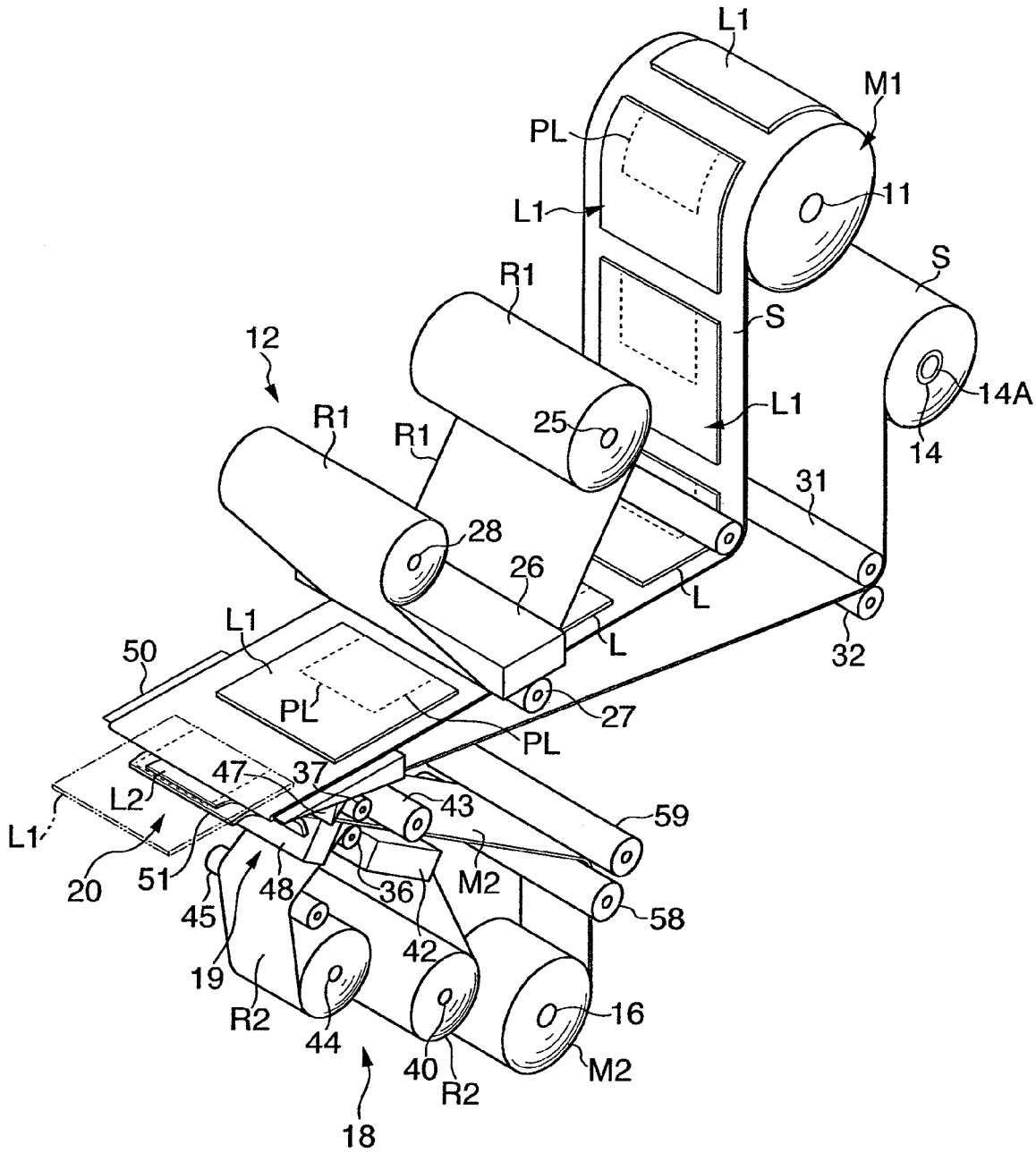
FIG. 2 is a schematic perspective view of the double-sided printing label printer as viewed thereabove, from which a sticking device is removed.
Figure 3:
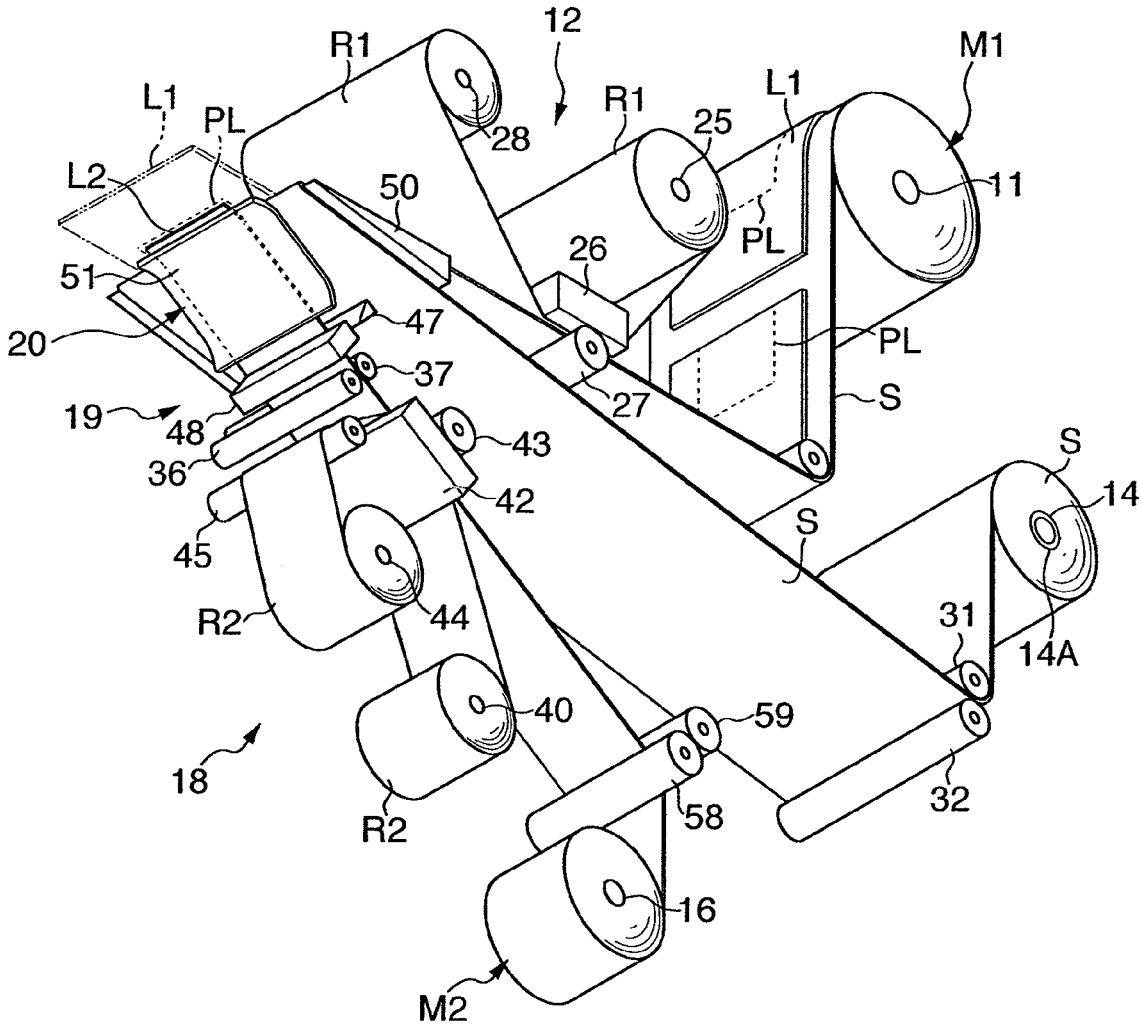
FIG. 3 is a schematic perspective view of the double-sided printing label printer as viewed thereunder, from which the sticking device is removed.

FIG. 1 shows a schematic front view of a double-sided printing label printer according to a first embodiment; FIG. 2 shows a schematic perspective view of a part of the double-sided printing label printer as viewed from a point thereabove; and FIG. 3 shows a schematic perspective view of a part of the double-sided printing label printer as viewed from a point thereunder. Referring to these figures, the double-sided printing label printer 10 comprises a first support roll 11 that supports a first label raw sheet M1 having a roll-like shape in which a plurality of first labels L1 is temporarily stuck on one surface of a strip of release liner S at predetermined intervals, a first printing device 12 that performs printing on a first label L1 while the first label raw sheet M1 is fed out from the first support roll 11, a first drive unit 13 that imparts a feed-out force to the first label raw sheet M1, a winding roll 14 that winds the release liner S, a second support roll 16 that supports a second label raw sheet M2 with no adhesive layer, a second drive unit 17 that imparts a feed-out force to a second label raw sheet M2, a second printing device 18 that performs printing on the second label raw sheet M2 while the second label raw sheet M2 is fed out, a cutting device 19 that cuts off the printed second label raw sheet M2 at every predetermined length to form a second label L2, a laminating section 20 that laminates an unprinted surface of the second label L2 onto adhesive layer A side (rear face side) of the first label L1 and discharges the first and second labels L1 and L2 in a state that the adhesive layer A of the first label L1 is partially exposed out of the second label L2, and a sticking device 21 that holds the first and second labels L1 and L2 discharged from the laminating section 20 and sticks the labels L1 and L2 onto an object W.

As shown in FIGS. 2 and 4-7, the first label L1 has a substantially square shape in a plane view, and an adhesive layer A is formed on the entire rear face thereof. Inside the surface of the label L1, a perforated line PL, which has a substantially U-like shape, is formed as a cutoff line. The perforated line PL is formed in such a manner that, in the feed-out direction of the first label raw sheet M1, an open side of the U-like shape portion is located at the downstream side.

The first printing device 12 comprises a first ribbon holding roll 25 that holds a first ink ribbon R1 wound in a roll-like shape, a first printing head 26 that prints out a predetermined piece of printing information using the first ink ribbon R1, which is fed out from the first ribbon holding roll 25 and goes through between the first printing head 26 and the label L1, a first platen roll 27 opposed to the first printing head 26, a first ribbon winding roll 28, a drive unit (not shown) that drives to rotate the first ribbon winding roll 28. The first printing head 26 according to this embodiment is composed of a thermal head to perform the printing using the first ink ribbon R1. However, when the first label L1 is made of a heat sensitive paper, the first ink ribbon R1 is not required. Also, in place of the thermal head, an ink-jet printer, a laser printer and the like may be employed.

The first drive unit 13 is disposed immediately before the winding roll 14. The first drive unit 13 comprises a drive roll 31 coupled with an output shaft 30A of a motor 30 and a pinch roll 32 that pinches the release liner S between the drive roll 31 and the same. The output shaft 30A of the motor 30 and a rotary shaft 14A of the winding roll 14 are provided with a pulley (not shown) respectively and a sliding belt is laid around between the pulleys. Owing to this arrangement, when the motor 30 is driven, a feed-out force is given to the first label raw sheet M1 and a winding force is given to the release liner S simultaneously.

Figure 4:
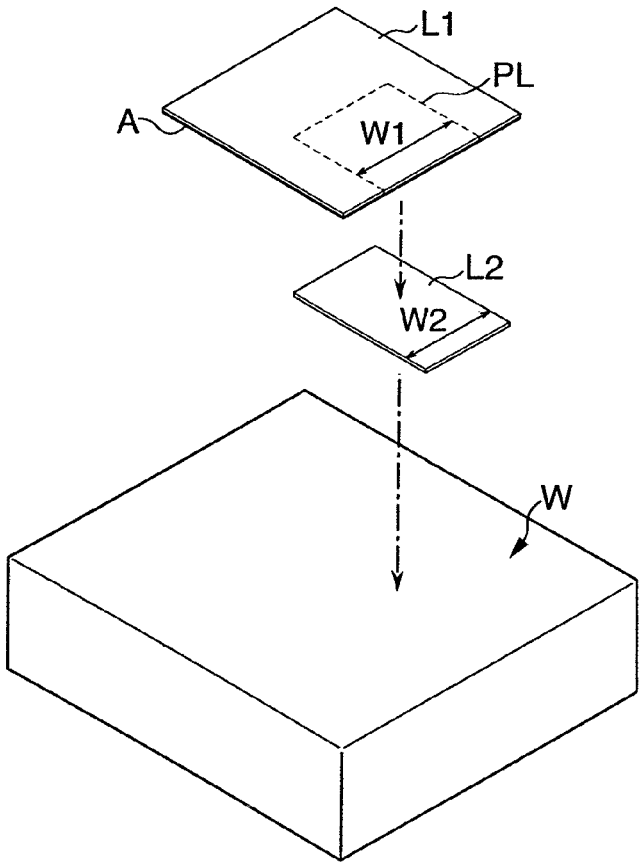
FIG. 4 is an exploded perspective view of a first label, a second label and an object.

The second label raw sheet M2 employs a strip of continuous plain paper or the like. As shown in FIG. 4, the second label raw sheet M2 is formed to have a width W2 smaller than a width W1 of the perforated line PL formed in the first label L1.

The second drive unit 17 comprises a motor 35, a drive roll 36 coupled with an output shaft of the motor 35 and a pinch roll 37 that pinches the second label raw sheet M2 between the drive roll 36 and the same.

The second printing device 18 is disposed immediately before the second drive unit 17. The second printing device 18 comprises a second ribbon holding roll 40 that holds a second ink ribbon R2 wound in a roll-like shape, a second printing head 42 that prints out a predetermined piece of printing information using a second ink ribbon R2, which is fed out from the second ribbon holding roll 40 and goes through between the second printing head 42 and second label raw sheet M2, a second platen roll 43 opposing to the second printing head 42, a second ribbon winding roll 44, a guide roll 45 disposed between the second ribbon winding roll 44 and the second printing head 42 and a drive unit (not shown) that drives to rotate the second ribbon winding roll 44. The structure of the second printing device 18 is substantially equivalent to that of the inverted first printing device 12. Therefore, a modification of the above-described first printing device 12 may be employed.

Figure 5:
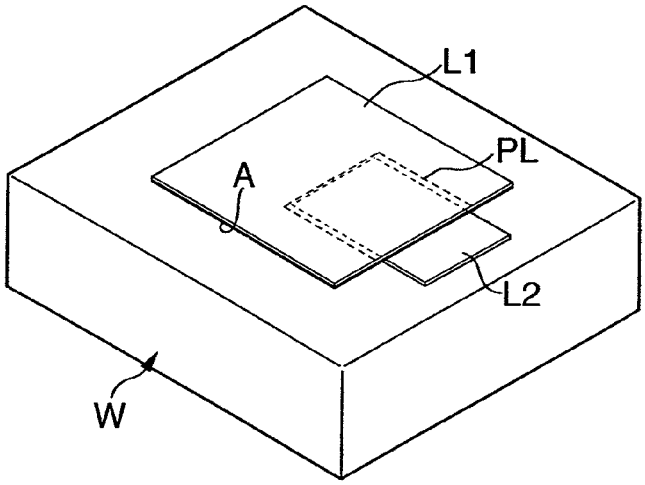
FIG. 5 is a schematic perspective view showing a state that the first and second labels are stuck onto the object.

The cutting device 19 is disposed immediately close to the second drive unit 17 at the downstream side thereof. The cutting device 19 comprises a cutter blade 47, which has a length corresponding to the width W2 of the second label raw sheet M2, and a cutter die 48. The cutter blade 47 is arranged to cut off the second label raw sheet M2 in the width direction thereof at preset timing thereby forming the second label L2 having a predetermined length. In this embodiment, the length of the second label L2 is set to a length in which, when the first and second labels L1 and L2 are laminated one another, the rear end of the second label L2, which is located at the downstream side in the feed-out direction, protrudes from the outer edge of the rear end of the first label L1 as shown in FIG. 5.

The laminating section 20 comprises a peel plate 50 for sharply turning back the feed-out direction of the first label raw sheet M1 thereby peeling off the first label L1 from the release liner S, and a guide plate 51 located below the peel plate 50 for guiding the second label L2, which is formed of the second label raw sheet M2 and is cut off after being subjected to the printing, to the adhesive layer A side of the first label L1. The guide plate 51 is disposed so that the left end thereof in FIG. 1 is located at the front-end side of the peel plate 50, and the right end thereof is located at the cutter die 48 side. Owing to this arrangement, the second label L2 is guided so as to flow together with the first label L1, and the unprinted surface of the second label L2 is stuck to the adhesive layer of the first label L1, which sequentially comes out from the front end of the peel plate 50.

The sticking device 21 comprises a suction plate 55 and a cylinder 56 that supports the suction plate 55 so as to move toward and away from the object W. The suction plate 55 has many suction holes (not shown) at the bottom face side thereof and is arranged so as to suck and hold the first and second labels L1 and L3 in a state that the first and second labels L1 and L2 are laminated being overlapped with each other. In FIG. 1, reference numerals 58 and 59 indicate a set of pinch rolls.

Description of the entire operation in the first embodiment is made below. For the convenience of description, it is assumed herein that the object W be a home delivery article; the first label L1 to be printed with information such as delivery destination of the article; and the second label raw sheet M2 (second label L2) to be printed with information to be concealed such as, for example, amount of money to be received, name of article, date etc.

The above-described printing information is inputted in advance through an input device and control device (not shown). When the first drive unit 13 and the second drive unit 17 are driven respectively, winding operation of the release liner S begins to feed out the first label raw sheet M1, and the second label raw sheet M2 is fed out at predetermined timing so as to abut on the first label L1.

The first label L1 is printed with information such as delivery destination of the object W (article) on the upper side thereof in FIG. 1 and then sequentially peeled off at the front-end side of the peel plate 50. The second label raw sheet M2 is cut off by the cutting device 19 after being printed with printing information such as amount of money to be received or amount billed, name of article, date and the like on the bottom side in FIG. 1. The cutting operation is carried out after the front end of the unprinted surface side (upper side in FIG. 1) of the second label L2 is attached to the adhesive layer A of the first label L1. Therefore, the support of the second label L2 is maintained even when the second label raw sheet M2 is cut off. Here, the second label L2 is arranged to have a length as described below. That is, when the second label L2 is fed out with its front end in the feed-out direction positioned at the inner side immediately close to the perforated line PL along the width direction of the first label L1, the rear side thereof protrudes from the outer edge of the rear end of the first label L1.

Figure 6:
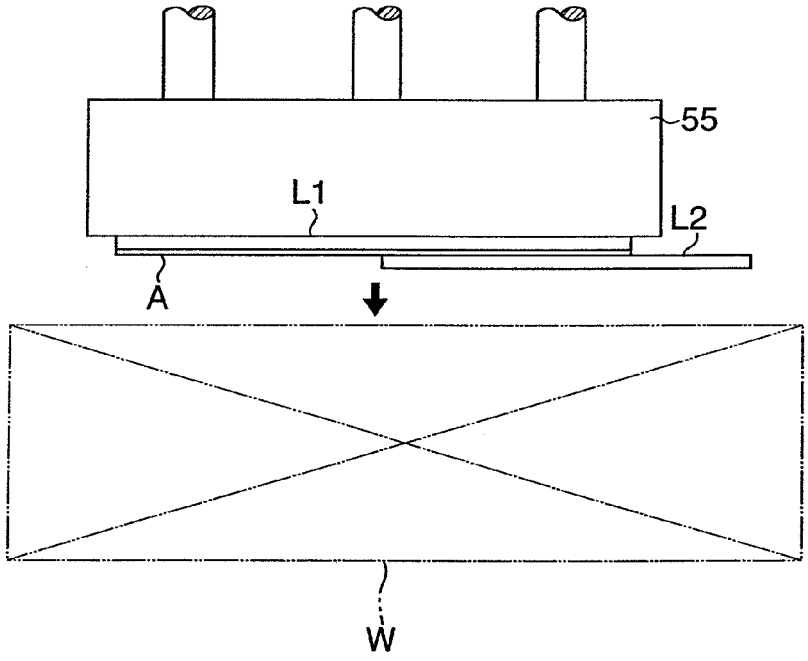
FIG. 6 is a schematic front view showing a state immediately before the first and second labels are stuck onto the object.

When the second label L2 is stuck to the adhesive layer A of the first label Ll sequentially peeled off at the front end of the peel plate 50, these first and second labels Ll and L2 are sequentially laminate with one another and are sucked by the suction plate 55 in the stuck state. Here, in order to reliably carry out the laminating, the second label L2 is pressed toward the adhesive layer A side of the first label Ll by means of an air blow from an air blowing device 510 at the downstream side of the peel plate 50. After that, when the suction plate 55 is made proceed (descend) toward the object W by the operation of the cylinder 56, the adhesive layer A of the first label Ll exposed outside of the second label L2 is stuck to the object W in a state that the printed surface of the second label L2 is concealed between the object W and the same as shown in FIG. 6.

Figure 7:
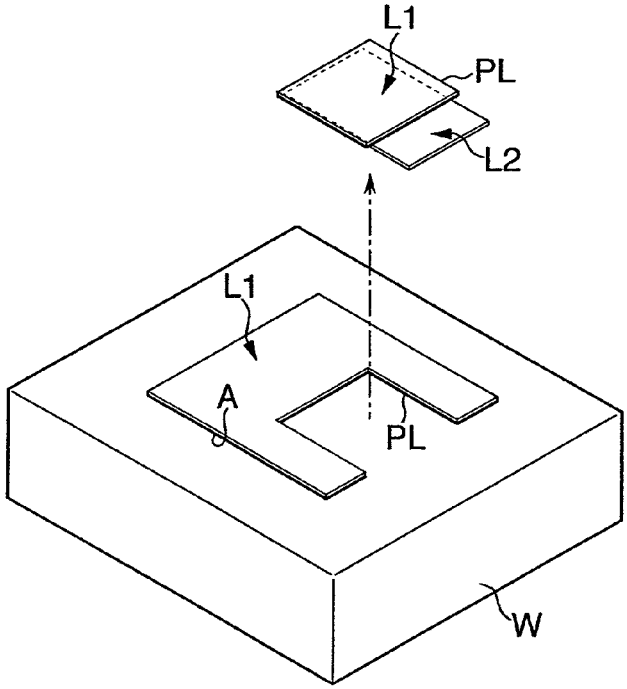
FIG. 7 is a schematic perspective view showing a state that the second label is torn off along with a part of the first label.
Figure 8:
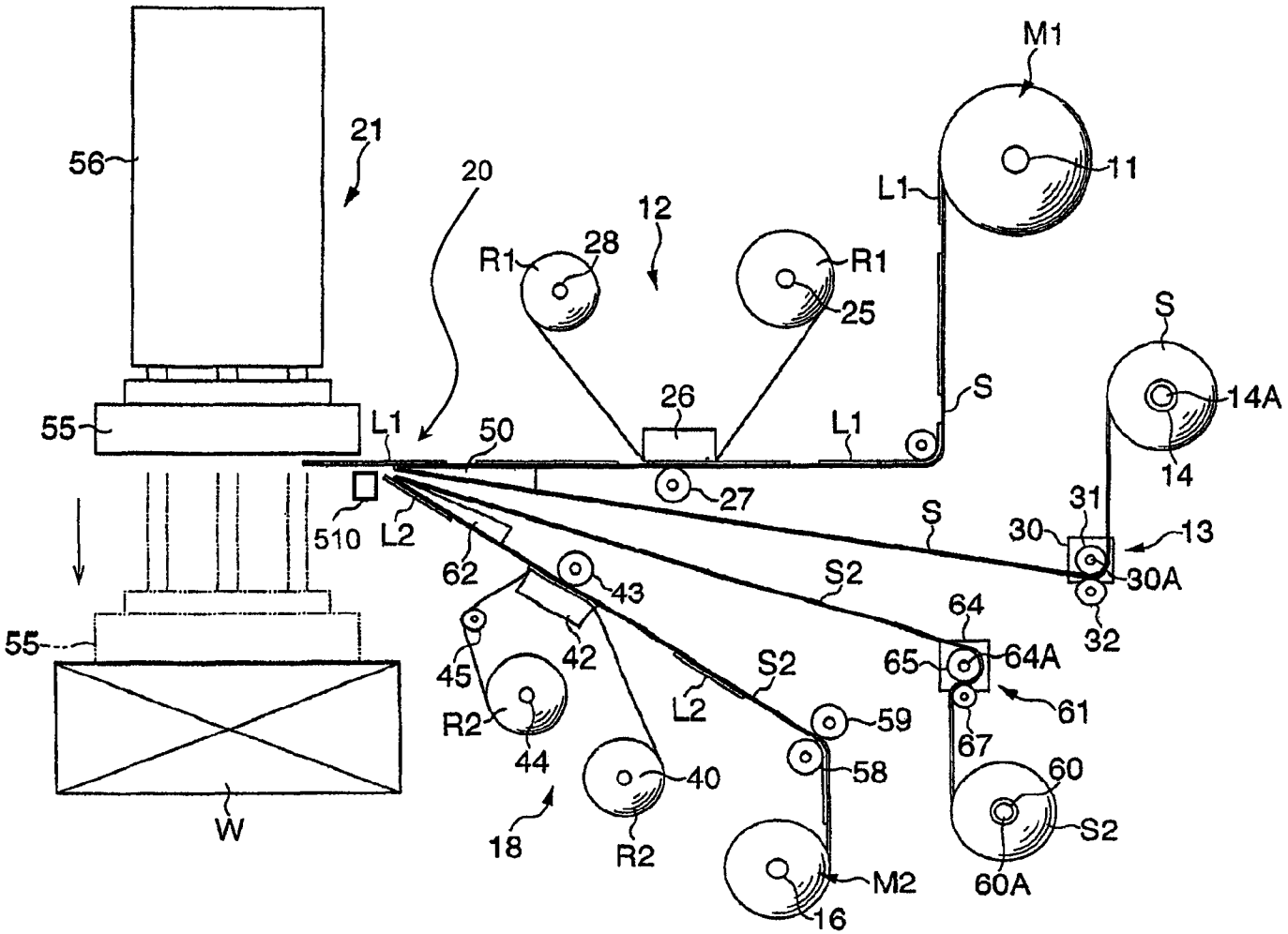
FIG. 8 is a schematic front view of the double-sided printing label printer according to a second embodiment.
Figure 9:
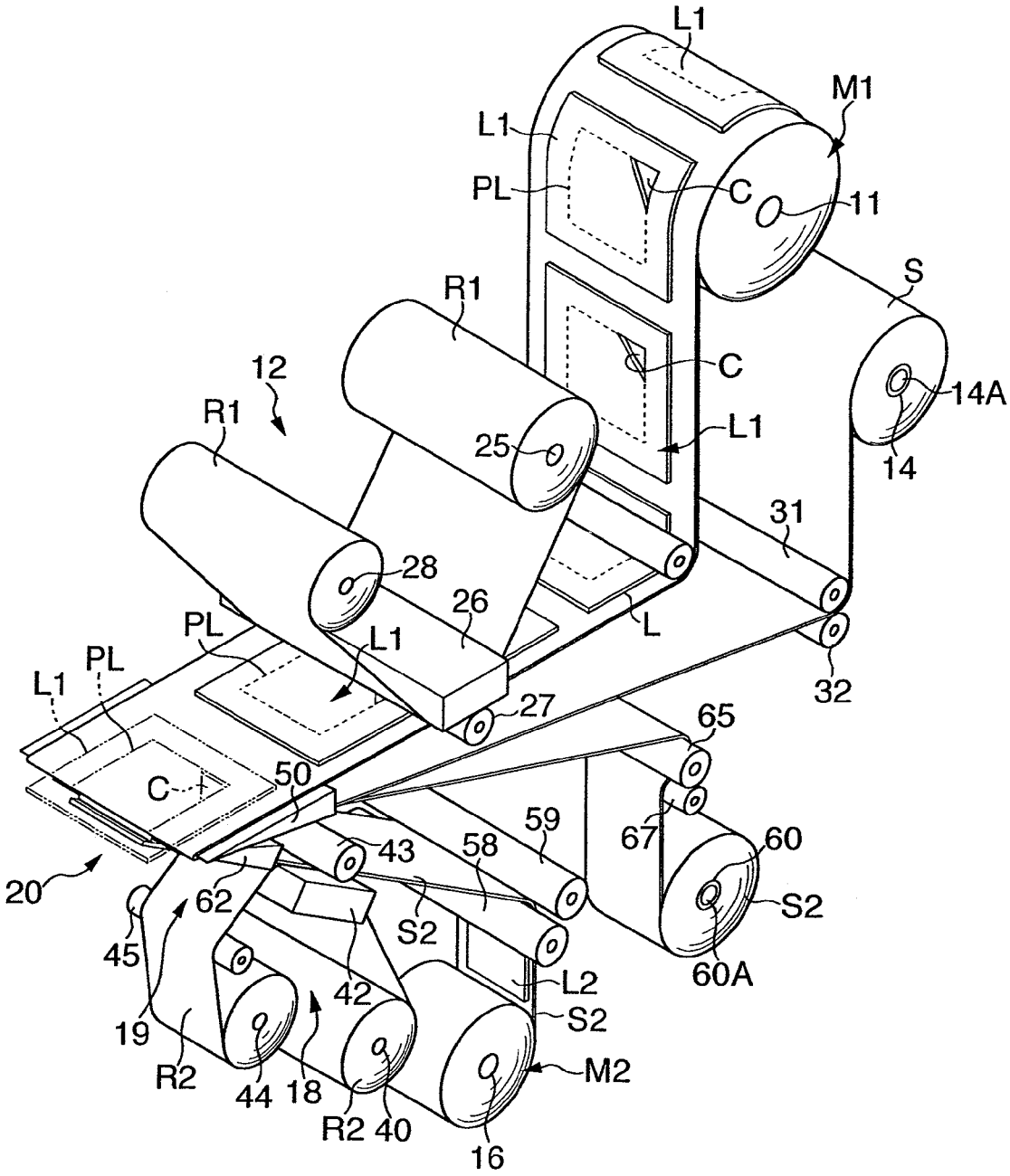
FIG. 9 is a schematic perspective view of the second embodiment same as FIG. 2.
Figure 10:
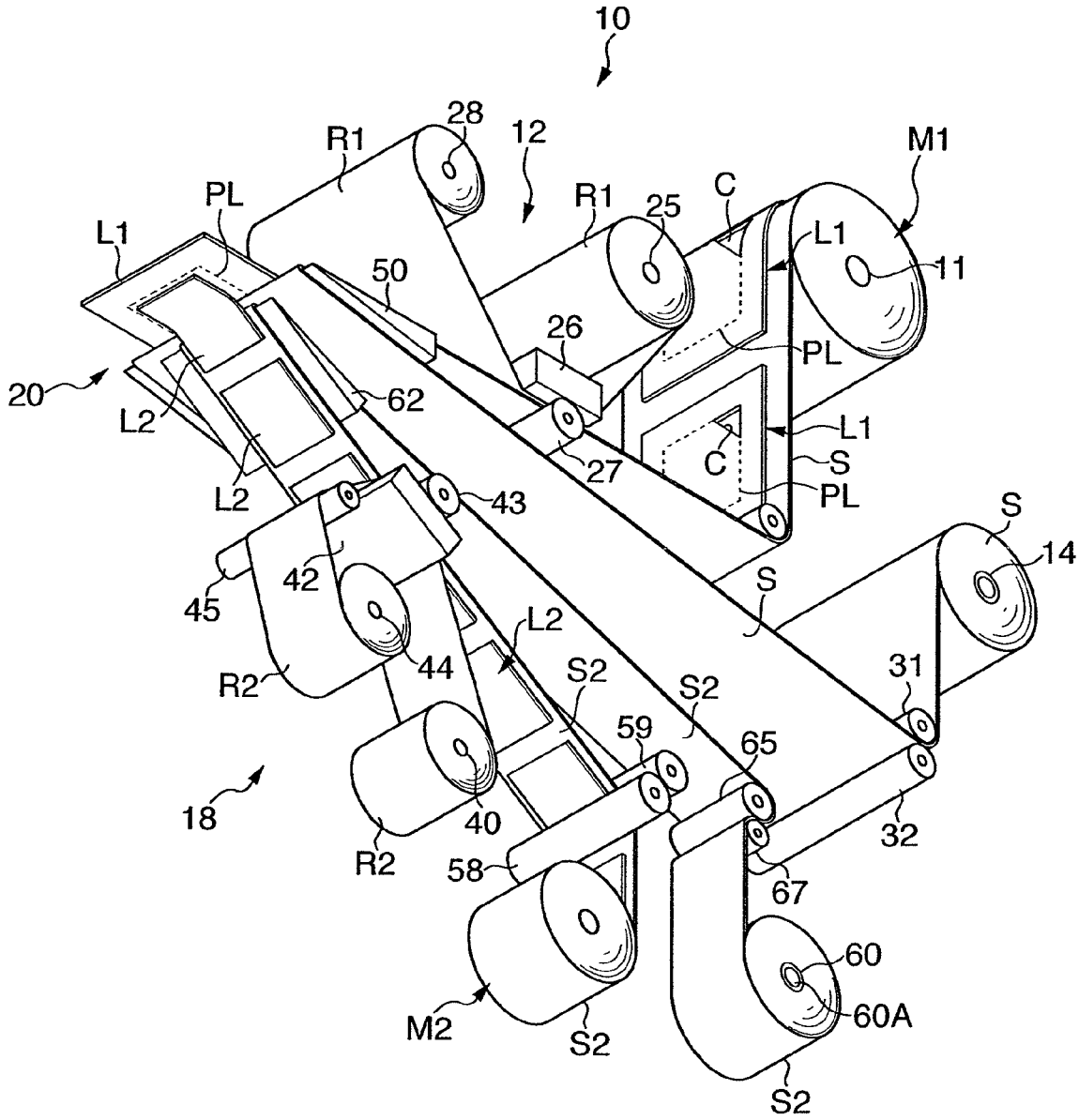
FIG. 10 is a schematic perspective view of the second embodiment same as FIG. 3.

Therefore, according to the above-described first embodiment, it is arranged in such a way that the unprinted surface of the second label L2 is stuck to the adhesive layer A of the first label L1 and the printing is made on the rear face side of the second label L2. Therefore, the necessity to limit the adhesive layer A of the first label L1 to a specific area is eliminated. Also, the first embodiment is arranged to stick the second label L2 to the object in a state that the printed information is concealed with no limitation on the printing area of the second label L2 positioned at the rear face side of the first label L1. As a result, the second label L2 can be cut off along with a part of the first label L1 along the perforated line PL formed in the surface of the first label L1 as shown in FIG. 7.

The following describes embodiments of the present invention other than the above-described embodiment. In the following embodiments, component parts identical or equivalent to those in the first embodiment will be given with identical reference numerals and descriptions thereof will be omitted or made briefly.

Second Embodiment

FIGS. 8 through 12 show a second embodiment of the present invention. The second embodiment uses a second label raw sheet M2 temporarily stuck with a second label L2 on one surface of a strip of release liner S2. It is arranged that, while the second label raw sheet M2 is fed out, the second label L2 is peeled off and an unprinted surface side thereof is laminated with an adhesive layer A of a first label L1. A perforated line PL of the first label L1 is formed in a closed loop along the periphery of a square shape having a substantially similar shape, which is smaller than the plane shape of the first label L1. A cut-off C, which has a triangle shape in plane view, is formed in one corner by a die-cut device or the like in the previous process so that one corner of the second label L2 can be seen from the outside in a state being laminated in an inner area of the perforated line PL (refer to FIG. 11).

To effect the above arrangement, in the second embodiment, a winding roll 60 for winding the release liner S2 is provided and a second drive unit 61 is provided immediately before the winding roll 60. Also, a lower peel plate 62 is provided for peeling off the second label L2 after the printing is carried out on the second label L2. Thus, the laminating section 20 includes the lower peel plate 62 and the peel plate 50 for peeling off the first label L1.

The second drive unit 61 comprises a drive roll 65, which is coupled with an output shaft 64A of a motor 64, and a pinch roll 67, which pinches the release liner S2 between the drive roll 65 and the same. Each of the output shaft 64A of the motor 64 and the rotary shaft 60A of the winding roll 60 is provided with a pulley (not shown), and a sliding belt is laid around between these pulleys. Owing to this arrangement, when the motor 64 is driven, a feed-out force of the second label raw sheet M2 and a winding force of the release liner S2 are given thereto simultaneously.

In the second embodiment, the labels Ll and L2 are laminated with each other at the laminating section 20 so that the second label L2 is positioned inside the perforated line PL of the first label Ll. In this embodiment also, in order to reliably carry out the laminating, the second label L2 is pressed toward the adhesive layer A of the first label Ll by an air blow from an air blowing device 510 at the downstream of the peel plate 50 and the lower peel plate 62. Therefore, the second label L2 is stuck to the object W in a state that the second label L2 is laminated within the first label Ll. When the second label L2 is torn off, the corner portion of the second label L2, which can be seen within the cut-off C, is picked and pulled up thereby tearing off the second label L2 along with a part of the first label Ll at the perforated line PL formed in the surface of the first label Ll (refer to FIG. 12).

The above-described second embodiment is arranged so that, using the second label raw sheet M2, in which the second label raw sheet M2 is temporarily stuck with the second label L2 on the release liner S2, the second label raw sheet M2 is sequentially peeled off by the lower peel plate 62. Therefore, the cutting device 19, which is employed in the first embodiment, can be eliminated.

Third Embodiment

Figure 13:
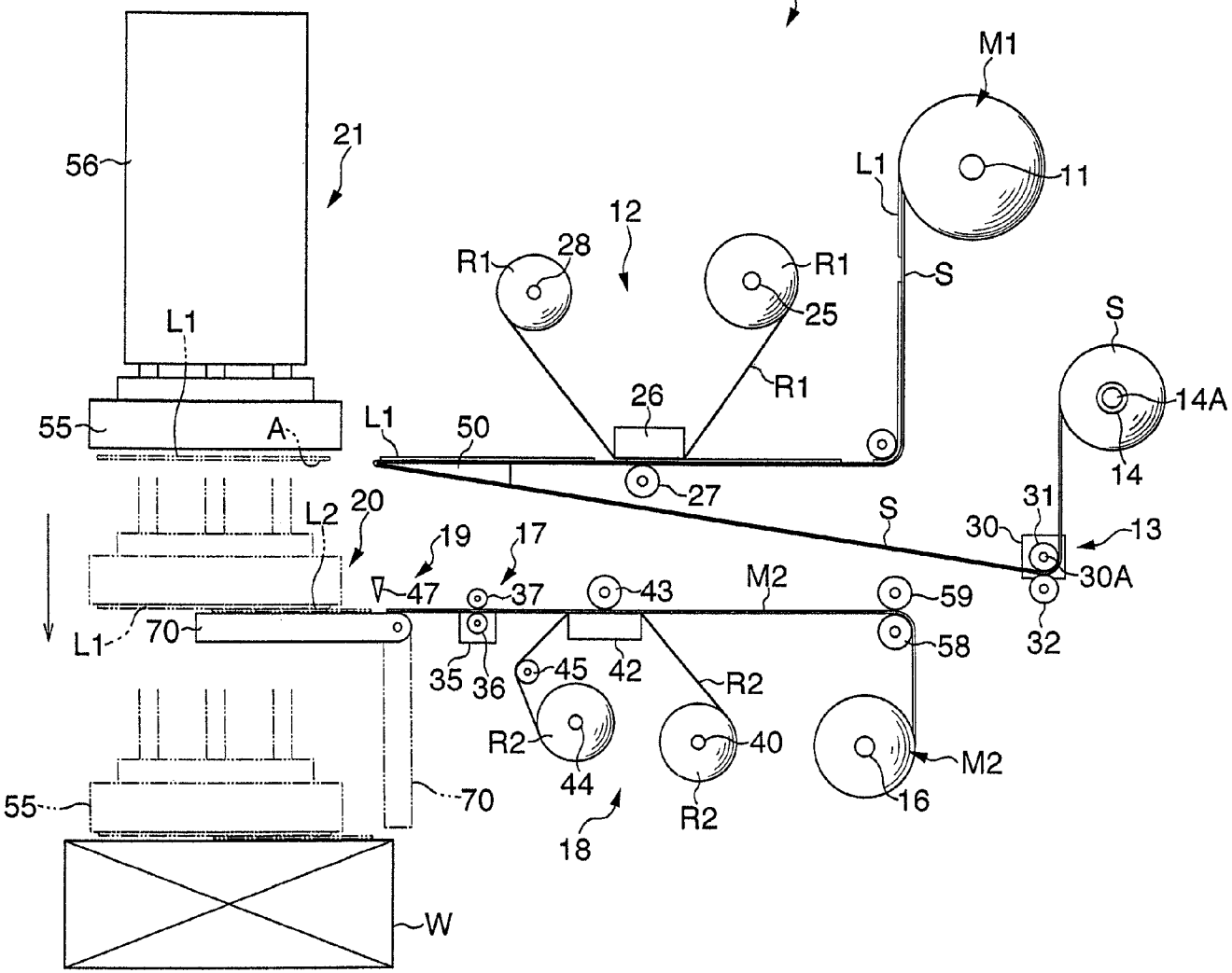
FIG. 13 is a schematic front view of the double-sided printing label printer according to a third embodiment.

FIG. 13 shows a third embodiment of the present invention. The third embodiment is characterized in that the laminating section 20 is arranged in such a way that the feed-out direction of the second label raw sheet M2 is substantially parallel to the feed-out direction of the first label raw sheet M1; and while the suction plate 55 of the sticking device 21 sucks the first label L1 and moves to the object W, an unprinted surface of the second label L2 is laminated with the surface of the adhesive layer A of the first label L1.

To effect the above arrangement, in the third embodiment, the guide plate 70 is disposed at the downstream side of the second drive unit 17, and a cutter 47 is disposed at the upper face side of the guide plate 70. The upper side of the guide plate 70 is formed with many suction holes (not shown) so as to suck and hold the second label L2. The guide plate 70 is arranged to rotate between a position substantially along the feed-out direction of the second label L2 as indicated with a solid line in FIG. 13 and a position substantially perpendicular to the feed-out direction as indicated with a chain double dashed line as shown in FIG. 13. The upper portion of the guide plate 70 is arranged to function as a cutter die.

In the third embodiment, the suction plate 55 sucks the first label L1, which is peeled off at the peel plate 50, and the suction plate 55 descends toward the object W. While descending operation, the descending is temporarily stopped at a position where the adhesive layer A is stuck with the unprinted surface of the second label L2, which is fed out onto the guide plate 70 and cut off by the cutter 47. Owing to this, the first and second labels L1 and L2 are laminated with one another. After that, the guide plate 70 rotates to the position indicated with the chain double-dashed in FIG. 13, to change its position to escape from the descending course of the suction plate 55. In this state, when the suction plate 55 further descends, the first and second labels L1 and L2 can be stuck onto the object W in a state that the printed surface of the second label L2 is hidden.

According to the third embodiment as described above, the first label L1 and the second label L2 can be laminated more reliably, vertical dimension of the entire apparatus can be reduced.

The best arrangement and method for carrying out the present invention have been disclosed so far. However, the present invention is not limited to the above.

That is, the present invention has been illustrated and described mainly about a specific embodiment. However, it is possible for those skilled in the art to add various modifications, if necessary, to the above-described embodiment with respect to the shape, position and/or disposition without departing from the technical spirit and the range of the object of the present invention.

For example, in the second embodiment, the second label L2 is arranged to be laminated with the first label L1 without protruding out of the periphery of the first label L1. However, when an arrangement such that quasi-adhesion sticking with pressure is made on the second label L2, which is temporarily stuck on the release liner S2, is employed, same as the first embodiment, the second label L2 may be laminated with a part thereof protruding out of the outer edge of the first label L1. In this case, the first label raw sheet M1 does not have to be formed with the cut-off C.

Figure 11:
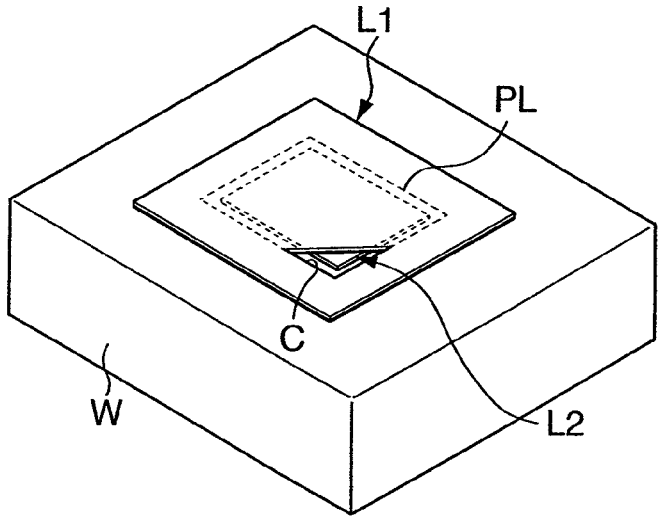
FIG. 11 is a schematic perspective view showing a state that the first and second labels are stuck onto the object in the second embodiment.
Figure 12:
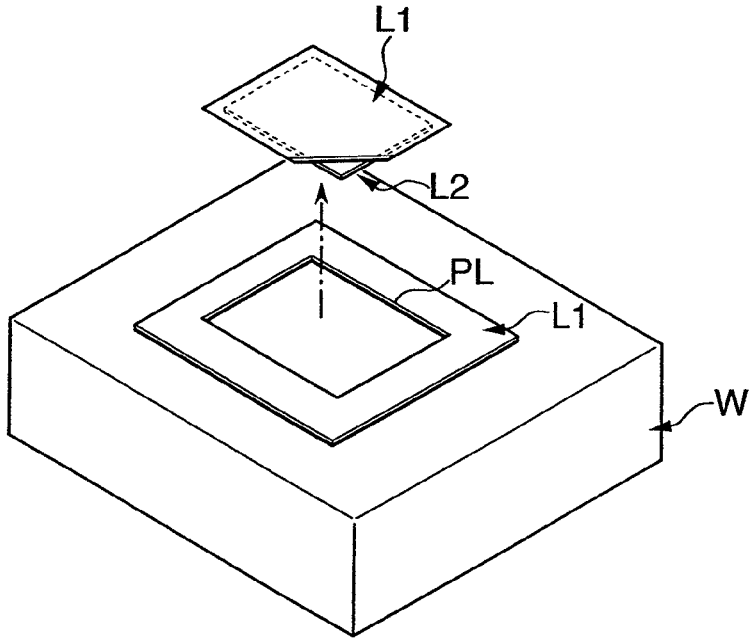
FIG. 12 is a schematic perspective view showing a state that the second label is torn off along with a part of the first label from the state in FIG. 11.

Also, in the third embodiment, an arrangement such that the label L2 can be conveyed to the guide plate 70 with a suction belt or the like is employed, same as the second embodiment, even when the perforated line PL of the first label L1 as shown in FIG. 11 has a closed loop smaller than the plane shape of the first label L1, the second label L2 can be laminated with the first label L1 in an area within the perforated line PL.

Further, the structure of the respective component parts according to the present invention is not limited to the examples of the illustrated structure. Various design changes are possible if the arrangement performs printing on each of the first label L1 and the second label L2 and laminating and discharging the labels in a state that unprinted surfaces of the respective labels L1 and L2 face to each other.

Furthermore, the present invention is not always required to have the sticking device 21 in the first and second embodiments. In this case, the first and second labels L1 and L2, which are sequentially laminated and discharged, may be stuck to the object by worker's hands, or may be stuck to the object W in another process. However, when the sticking device 21 is provided as the above-described embodiments, an application mode such that the double-sided printing label printer 10 is installed along a conveyance path of the object W in a distribution system can be employed.

What is claimed is:

1. A double-sided printing label printer, comprising:

a first printing device for printing on a first surface of a first label while the first label is being fed in a first feeding direction, the first label having an adhesive layer on an opposite, second surface thereof;

a second printing device for printing on a first surface of a second label while the second label is being fed in a second feeding direction, the second label further having an opposite, second surface; and a laminating section for laminating the second surface of the second label to the adhesive layer of said first label and for discharging the laminated first and second labels in a state where the adhesive layer of the first label is partially exposed out of the second label;

wherein said laminating section comprises an air blowing device for blowing an air blow to press the second label toward the adhesive layer of the first label to laminate the first and second labels.

2. The double-sided printing label printer according to claim 1, wherein said second label is a part of a strip of sheet, and said double-sided printing label printer further comprises a cutting device for cutting off said strip of sheet to a predetermined length to form said second label at a downstream side of said second printing device in the second feeding direction.

3. The double-sided printing label printer according to claim 2, further comprising:

a guide plate located downstream of the cutting device for guiding the printed and cut second label toward the laminating section for lamination with the printed first label.

4. The double-sided printing label printer according to claim 3, wherein the guide plate comprises a guide surface for supporting thereon the printed and cut second label being guided toward the laminating section; and upstream and downstream ends adjacent the cutting device and the laminating section, respectively, wherein said upstream and downstream ends are curved away from the guide surface.

5. The double-sided printing label printer according to claim 1, wherein said laminating section is further configured for guiding the first and second labels to flow together with each other.

6. The double-sided printing label printer according to claim 1, further comprising:

a sticking device for holding and sticking said first and second labels laminated with each other onto a predetermined object.

7. The double-sided printing label printer according to claim 1, wherein said second label is laminated in a state that a part thereof protrudes from an outer edge of said first label.

8. The double-sided printing label printer according to claim 1, wherein said second label is formed in a smaller size than that of the first label and is laminated without protruding from an outer edge of the first label.

9. The double-sided printing label printer according to claim 1, wherein said first label is formed with a cutoff line for permitting said first label to be cut off along with said second label.

10. The double-sided printing label printer according to claim 1, wherein said first label is formed with a cutoff line for permitting said first label to be cut off along with said second label, and a cut-out portion for partially exposing the second label laminated to the first label.

11. The double-sided printing label printer according to claim 1, further comprising:

a guide plate for guiding the printed second label toward the laminating section for lamination with the printed first label.

12. A double-sided printing label printer, comprising:

a first printing device for printing on a first surface of a first label while the first label is being temporarily stuck, by an adhesive layer on an opposite second surface thereof, to a first strip of release liner which is being fed in a first feeding direction;

a second printing device for printing on a first surface of a second label while the second label is being temporarily stuck, at an opposite second surface thereof, to a second strip of release liner which is being fed in a second feeding direction; and a laminating section for peeling each of said first and second labels off the first and second strips of release liner, respectively, for laminating the second surface of the second label to the adhesive layer of the first label, and for discharging the laminated first and second labels in a state that the adhesive layer of said first label is partially exposed outside the second label;

wherein said laminating section comprises an air blowing device for blowing an air blow to press the second label toward the adhesive layer of the first label to laminate the first and second labels.

13. The double-sided printing label printer according to claim 12, wherein said laminating section is further configured for guiding the first and second labels to flow together with each other.

14. The double-sided printing label printer according to claim 12, further comprising:

a sticking device for holding and sticking said first and second labels laminated with each other onto a predetermined object.

15. The double-sided printing label printer according to claim 12, wherein said second label is laminated in a state that a part thereof protrudes from an outer edge of said first label.

16. The double-sided printing label printer according to claim 12, wherein said second label is formed in a smaller size than that of the first label and is laminated without protruding from an outer edge of the first label.

17. The double-sided printing label printer according to claim 12 wherein said first label is formed with a cutoff line for permitting said first label to be cut off along with said second label.

18. The double-sided printing label printer according to claim 12, wherein said first label is formed with a cutoff line for permitting said first label to be cut off along with said second label, and a cut-out portion for partially exposing the second label laminated to the first label.

19. The double-sided printing label printer according to claim 12, further comprising:

a guide plate for guiding the printed second label toward the laminating section for lamination with the printed first label.

20. A double-sided printing label printer, comprising:

a first printing device for printing on a first surface of a first label while the first label is being fed in a first feeding direction, the first label having an adhesive layer on an opposite, second surface thereof;

a second printing device for printing on a first surface of a second label while the second label is being fed in a second feeding direction, the second label further having an opposite, second surface;

a laminating section for laminating the second surface of the second label to the adhesive layer of said first label and for discharging the laminated first and second labels in a state where the adhesive layer of the first label is partially exposed out of the second label; and a sticking device for sticking said first and second labels to a predetermined object, wherein the sticking device is arranged to form said laminating section and to laminate the second surface of said second label to the adhesive layer of the first label while the sticking device holds the first label and moves to said object.

* * * * *